United States Patent [19]

Smith

[11] 4,061,482

[45] Dec. 6, 1977

[54] COOLING COIL AND AIR DISTRIBUTION SYSTEM DEFROST MEANS

[75] Inventor: Robert Smith, Dayton, Ohio

[73] Assignee: General Motors Corporation, Detroit, Mich.

[21] Appl. No.: 745,551

[22] Filed: Nov. 29, 1976

[51] Int. Cl.[2] ..... F25D 21/08

[52] U.S. Cl. ..... 62/155; 62/180

[58] Field of Search ..... 62/155, 180, 234, 276

[56] References Cited

U.S. PATENT DOCUMENTS

| | | | |
|---|---|---|---|
| 2,907,180 | 10/1959 | Mann | 62/155 |
| 3,126,716 | 3/1964 | De Witte | 62/156 |
| 3,189,085 | 6/1965 | Eberhart | 165/12 |
| 3,316,729 | 5/1967 | Mann et al. | 62/156 |
| 3,922,874 | 12/1975 | Canter | 62/155 |

*Primary Examiner*—William E. Wayner
*Attorney, Agent, or Firm*—Edward P. Barthel

[57] ABSTRACT

A domestic refrigerator control arrangement for automatically defrosting the cabinet with a minimum of cycle time while obviating the buildup of frost within the cold air conduits. A defrost heater is located at the frontal area of the evaporator coils and the defrost thermostat on the rearward edge of the cross fins coil assembly in the air stream of the air circulating fan sensing the temperature of the air exiting the evaporator. The fan is wired in series with the defrost thermostat and operates upon the energization of the defrost heater, while being deenergized upon the opening of the defrost thermostat contacts at the end of the defrost period. The fan remains in its off position until the defrost thermostat recloses, insuring that moisture-laden air is not distributed throughout the refrigerator.

3 Claims, 7 Drawing Figures

COOLING COIL AND AIR DISTRIBUTION SYSTEM DEFROST MEANS

This invention relates to multiple compartment frost-free refrigerators and is directed to a cooling air distribution system and defrost arrangement therefor.

The defrost systems used in prior art refrigerators for controlling the operation of refrigerator defrost systems have not been entirely successful in preventing the buildup or accumulation of frost in the air distribution conduits or outlet ducts of the refrigerator cabinet. This is because in most systems the air moving fan is deenergized during the defrost cycle and remains so until the defrost period is completed. The result is that upon restarting of the refrigeration system the fan is energized and, since the cooling coil is still above 32° F., the fan distributes moisture-laden air throughout the refrigerator where it condenses and freezes when the temperature drops below freezing.

Accordingly, it is an object of the present invention to provide an improved refrigerator defrost control system which insures that moisture-laden air from the evaporator is not distributed in the refrigerator duct system and frozen therein.

It is another object of the present invention to provide an improved evaporator fan circuit for a domestic frost-free refrigerator wherein the defrost evaporator heater is located at the frontal portion of the cooling coil and the defrost thermostat is positioned on the rearward edges of the evaporator fins in the exiting air stream, and wherein the cabinet fan means is wired in series with the defrost thermostat so as to operate when the defrost heater is energized, resulting in a decreased defrost time interval because the defrost thermostat reacts to the evaporator air temperature as soon as it departs from the coil. Upon the frost being melted from the coil the air temperature will rise above freezing allowing the defrost thermostat opening temperature to be set so as to more closely approach 32° F. to melt any accumulated frost in the conduits.

Further objects and advantages of the present invention will be apparent from the following description, reference being had to the accompanying drawings, wherein a preferred embodiment of the present invention is clearly shown.

Figure 1:
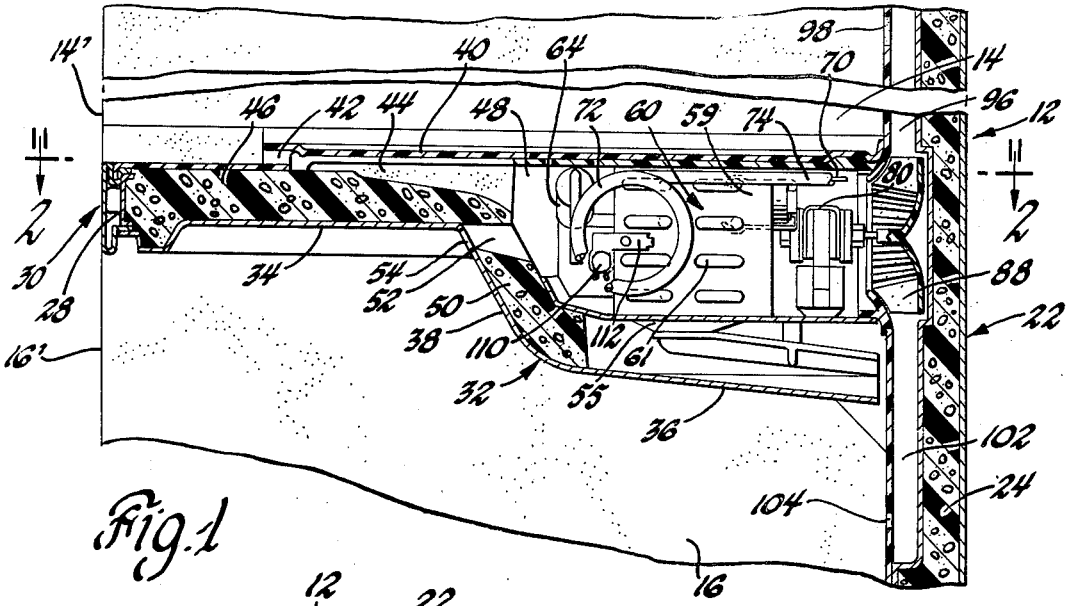
FIG. 1 is a fragmentary vertical sectional view of a frost-free refrigerator embodying one form of the invention.
Figure 2:
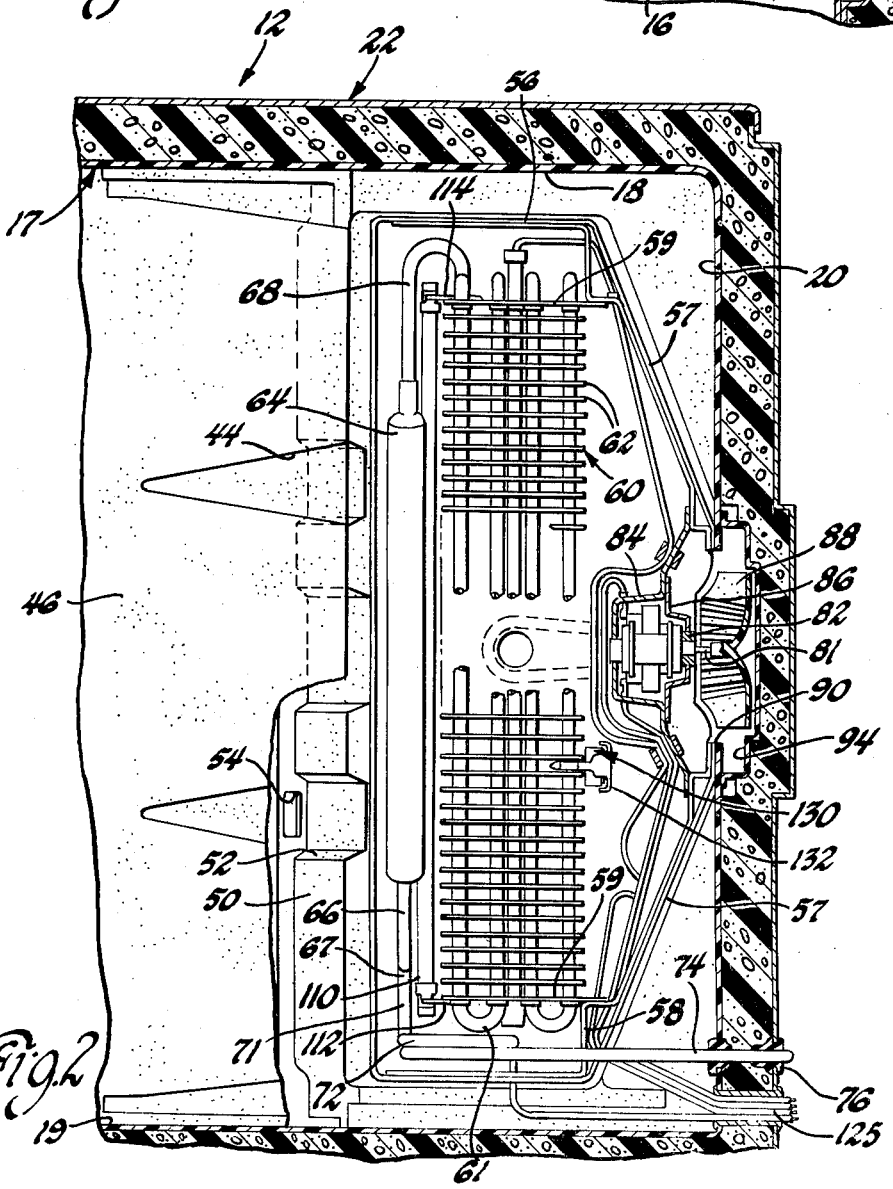
FIG. 2 is a fragmentary horizontal sectional view taken through the dividing wall along the line 2—2 of FIG. 1.

Referring now to the drawings and more particularly to FIGS. 1 and 2, there is illustrated an air distribution system of a household refrigerator 12 including an upper below-freezing compartment 14 and a lower 16 above-freezing or cooling compartment. The upper and lower compartments have front access openings 14′ and 16′, respectively, closed by upper and lower doors (not shown). Both the upper and lower compartments are enclosed within an inner liner 17 preferably formed out of a suitable sheet plastic with the liner side walls 18, 19 and the rear wall 20 being visible in FIG. 2. The space between the inner walls, formed by the inner liner 17 and an outer metal shell 22, is filled with expanded polyurethane foam 24 which is conventional practice. Suitable brackets (not shown) extend through openings in the edge flange and support a front metal cross member 28 extending between them. The details of one such refrigerator cabinet construction are shown, for example, in U.S. Pat. No. 3,599,442 issued to Robert S. Hanson and assigned to the same assignee as the present application.

As best seen in FIG. 1, the upper 14 and lower 16 compartments are separated by an insulated horizontal partition assembly 30 which includes a lower sheet metal wall 32 having a high front portion 34 and a rear low portion 36 with an inclined portion 38 in between. A top member 40 of the partition assembly is provided with a series of air entrances 42 which connect with air passages 44 in front of an insulation piece 46 and with an evaporator chamber 48. The evaporator chamber 48 is also surrounded by an insulation piece 50 having a passage 52 providing communication with the air entrance 54 from the above-freezing compartment 16 to the evaporator chamber 48.

Resting upon the rear lower portion 36 the cast foam insulation piece 50 supports a unitary removable cooling assembly in which a drain pan 55 serves as a supporting frame and extends beneath substantially the entire unit. The drain pan 55 is curved upwardly at the edges and at the sides and at the rear, and is provided with upwardly extending side 56 and rear 57 walls.

Figure 3:
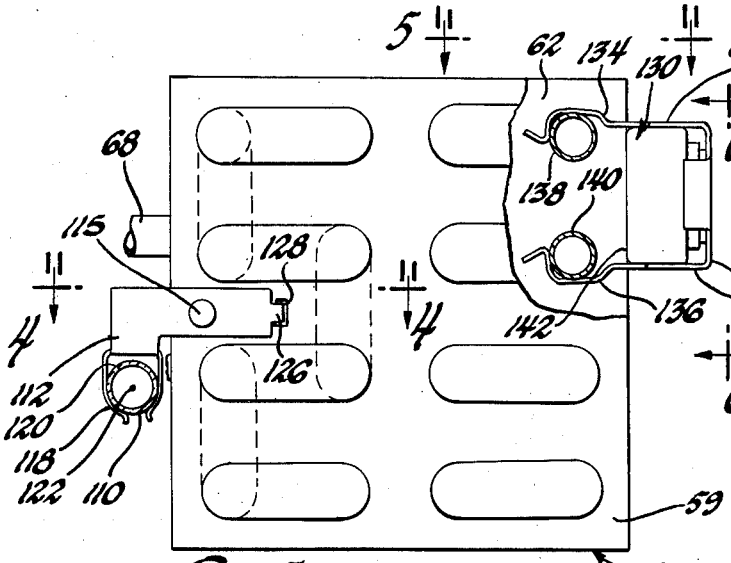
FIG. 3 is an enlarged and elevational view of the refrigerator evaporator.
Figure 5:
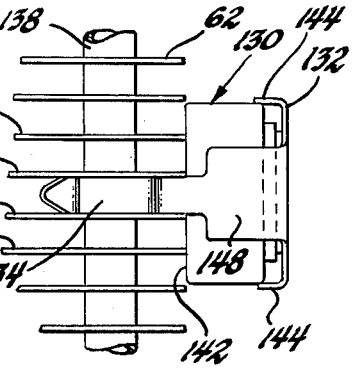
FIG. 5 is a fragmentary vertical elevational view taken on the line 5—5 of FIG. 3.

Connected to L-shaped brackets 58 by threaded fasteners are right and left header or end plates 59 of a refrigerant evaporator 60 having horizontal pieces of straight tubing connected by return bend tubes 61 extending in serpentine fashion through cross fins 62 extending from front to rear. The refrigerant evaporator 60 is generally rectangular on all sides with the end plates 59 substantially square-shaped as seen in FIG. 3.

The outlet of the evaporator is connected to a receiver 64 extending diagonally upwardly in front of the evaporator above the front of the drain pan. The upper end of the receiver 64 is connected by tubing 66 to the stem of a T-connection 67. The left half of the straight through portion of the T-connection 67 connects to the inlet 68 of the evaporator beneath the receiver. A capillary liquid supply tube 70 (FIG. 1) has its discharge end extending through the straight through portion of the T-connection 67 and necked-in portion of the inlet tube 71 for discharging liquid refrigerant thereto. The capillary tube 70 extends through the straight portion of the T-connection and through the coiled portion 72 of the suction line 74 to the machinery compartment shown in the mentioned Hanson patent. In this way a single entry arrangement in which the concentric capillary supply tube 70 and the suction conduit 74 can be readily passed through a double grommet 76 located in the rear wall for connection with a condensing system beneath the cabinet.

The cooling assembly includes fan means in the form of a fan motor 80 having concentric hubs at the ends of its axis shown held within vibration-absorbing rubber rings 82 (FIG. 2) which are mounted in apertures in the fan motor supporting members. The support members are in the form of a U-shaped fan motor bracket 84 and a transverse end motor bracket 85 extendng across the open end portion of the U-shaped bracket. The fan motor 80 has its drive shaft 81 extending rearwardly and is provided with a front inlet centrifugal fan blower or impeller 88. The drain pan rear walls are provided with a fan housing orifice extending around the side openings of the blower 88 in the vicinity of its peripheral blades. As seen in FIG. 2, the blower projects through an opening 90 in the cabinet plastic liner.

Located in the rear wall insulation 24 is a plastic duct 94 including a central scroll section surrounding the blower 88 and a wide upwardly-extending duct portion 96 extending to an upper outlet 98 in the rear wall of the plastic liner through which the air from the blower is discharged into the upper freezer compartment 14. A downwardly extending duct portion 102 extends to a smaller outlet 104 for the discharge of air into the lower above-freezing compartment 16. The aforementioned ducts and outlets are proportioned to the size and heat leaks of the upper 14 and lower 16 food compartments. In this way the upper compartment 14 is maintained at the desired temperature of between 0° and 10° F. and the lower compartment is maintained at a temperature of about 36° F. The fan blower 88 draws from the upper compartment 14 through the inlets 42 at the front of the plastic bottom wall 40 of the compartment into the evaporator compartment 48. The evaporator 60 is insulated from the upper compartment 14 by the slab of insulation 46 located between the wall and the evaporator. Air is also circulated from the lower compartment 16 through the openings 52 into the evaporator compartment 48 from which the combined air is drawn through the evaporator 60 and discharged by the blower 88 through the scroll section of the cabinet duct 102 and outlet 104 to the lower compartment 16.

Figure 4:
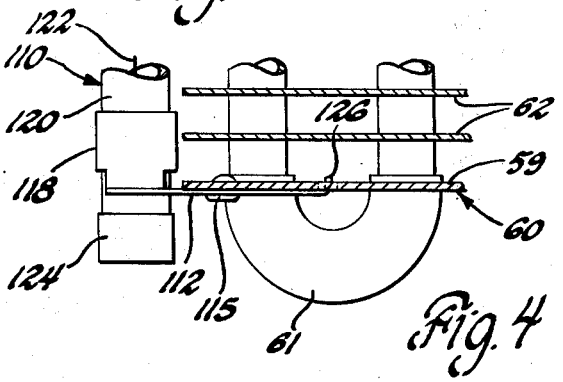
FIG. 4 is a fragmentary horizontal sectional view taken substantially along the line 4—4 of FIG. 3.
Figure 6:
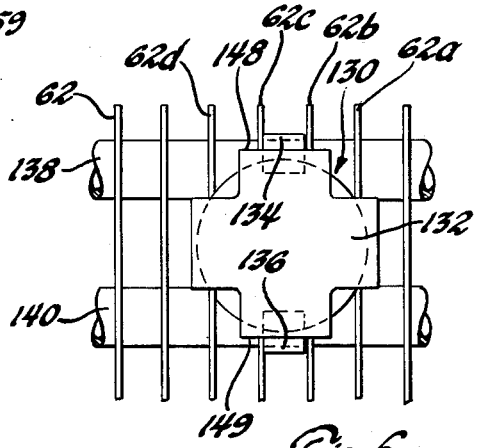
FIG. 6 is a vertical fragmentary elevational view taken on the line 6—6 of FIG. 3.

As shown in FIGS. 1 and 2, a transversely extending radiant defroster heater, generally indicated at 110, is located at the frontal area of the evaporator 60, defined by the front edges of the fins 62, so as to extend substantially coextensive therewith. The ends of the heater 110 are supported by spring brackets 112 and 114 riveted at 115 to and protruding forwardly from the evaporator end plates, the right hand plate being shown in enlargement at 59 in FIG. 3. The brackets include spring fingers 118 which resiliently grip an outer glass tube or lamp 120 enclosing a filament 122 (FIG. 4). The filament extends substantially the lamp length with its ends electrically terminating in metal connector plates 124. Suitable wiring for the fan motor 80 and for terminals at the ends of the radiant defrost heater tube is indicated generally at 125 in FIG. 2 extending through the cabinet backwall. It will be noted that the brackets, as shown by bracket 112, each have a locating tab 126 which is received in plate aperture 128 to correctly position bracket 112. Thus, lamp 120 is located substantially midway between the upper and lower extremities of the evaporator 60 adjacent the front edges of its fins 62.

A defrost thermostat, generally shown at 130 in FIG. 2, is supported in contact with the rearward edges of a plurality of the cross fins 62 by means of a U-shaped support 132 having side flanges 133 upper and lower spring legs 134 and 136 extending between adjacent fins **62*b* and 62*c* so as to contact the inner faces thereof. The spring legs 134, 136 resiliently engage the longitudinally extending evaporator coils 138 and 140 to position the forward face 142 of the thermostat 130 in thermal contact with the rearward edges of the cross fins 62*a*–62*d*. The defrost thermostat 130, retained in support bracket 132 by integral side flange 144 and upper and lower flanges 148 and 149 respectively, is located adjacent the central portion of the evaporator such that it is located in the intake air stream of the blower 88. By virtue of locating the detrost thermostat 130 inboard of the evaporator chamber 48 air inlet passages 52 it will be appreciated that the thermostat 130** is positioned to sense the air temperature as it leaves the rearward edge of the evaporator.

Figure 7:
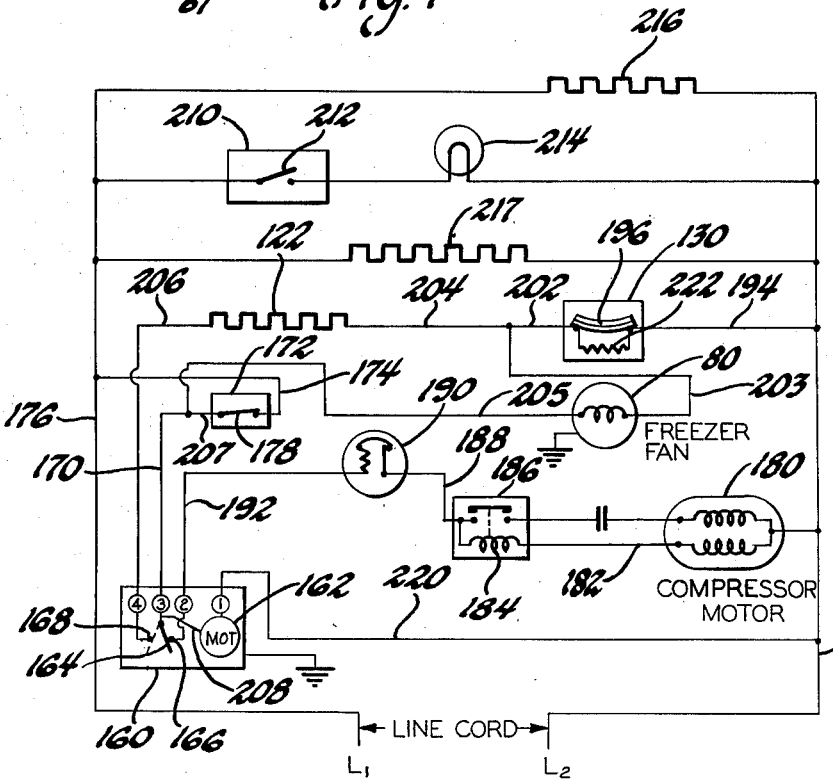
FIG. 7 is a schematic diagram illustrating the control circuit of the present invention.

With regard to the schematic diagram of FIG. 7, it will be seen that a defrost timer 160 is of conventional structure of the general type shown in U.S. Pat. No. 3,914,951 to J. H. Heidorn, issued Oct. 28, 1975. The defrost timer 160 includes a timer motor 162 controlling the movable contact arm 164 of a double throw switch which serves to selectively energize a defrost cycle circuit or a compressor run cycle circuit of the refrigeration system. The timer 160 serves to position the movable switch arm 164 from its full line position contacting fixed contact 166 to its dotted line position contacting fixed contact 168 once every 8 hours, for example. The movable contact switch arm 164 when in its solid line run position supplies current to the line 170 and the temperature or cold control thermostat 172. The thermostat 172 responds to refrigeration requirements and serves to close the circuit to the line 174 and thence to line 176, which is always energized to the $L_1$ side of the power source, whenever refrigeration is required. The thermostat 172 is preferably located in the above-freezing compartment 16 and opens the circuit to the compressor 180 at 36° F. and recloses at about 40° F.

When the movable contact arm 178 of the cold control thermostat 172 is in its closed position, the compressor will operate via the circuit from the $L_2$ side of the power source line 179, the compressor motor 180, line 182 winding 184 of relay 186 line 188, motor protector 190, line 192 fixed timer contact 166, movable contact 164, line 170, closed cold control contact arm 178, line 174, and line 176 to the $L_1$ side of the power source. A second freezer fan circuit, in parallel with the above-described compressor circuit, is established during the run cycle of the compressor via the $L_2$ side of the power source, line 194, the movable bimetal disc contact 196 of defrost thermostat 130, lines 202 and 203, freezer fan motor 80, lines 205 and 207, closed contact 178 of the cold control 172 and lines 174 and 176 to the $L_1$ side of the power source.

In the disclosed embodiment upon the timer synchronous motor 162 positioning the timer movable contact arm 164 in its dotted line position in contact with fixed contact 168 a defrost mode of operation is established by the circuit from the $L_1$ side of the power source, lines 176 and 174, the closed contact 178 of the cold control 172, lines 207 and 170, the movable contact 164 and the fixed contact 168 of the timer, line 206, defrost heater 122, lines 204 and 202, movable contact 196 of the defrost thermostat, and lines 194 and 179 to the $L_2$ side of the power source.

At the same time the defrost timer switch energizes the freezer fan 80 by means of a circuit from the $L_1$ side of the power source, lines 176 and 174, the closed cold control contact 178, lines 207 and 205, freezer fan motor 80, lines 203 and 202, defrost thermostat closed contact 196 and lines 194 and 179 to the $L_2$ side of the power source. Thus, the fan motor 80 is wired in series with the defrost thermostat 130 and operates whenever the defrost heater filament 122 is energized.

The circuit of FIG. 7 further includes a conventional door lamp switch 120 having a movable contact 212 which closes to energize refrigerator lamp 214. A conventional drain heater 216 and mullion drier heater 217 are also shown in the circuit. The timer motor 162 is connected by line 220 and line 179 to the $L_2$ side of the power source while the line 208 connects the other side of the motor 162 to the $L_1$ side of the power source. It will be noted that the resistance 222, in parallel with defrost thermostat movable contact disc 196, is of a predetermined value which is sufficiently high enough to insure that the freezer motor 80 and defrost heater 122 are not energized upon the opening of the contact 196.

In the disclosed embodiment the defrost limiter thermostat 130 thermal element in the form of the bimetal disc 196 is designed to open its contacts, which are normally closed at the beginning of a defrost cycle, upon the rise of temperature of the air stream departing the evaporator to about 50° F. to terminate the defrosting operation. The bimetal disc 196 is designed to reclose or "snap back" at a temperature of about 30° F.

While the embodiment of the present invention as herein disclosed constitutes a preferred form, it is to be understood that other forms might be adopted.

I claim:

1. In combination, a refrigerator cabinet having an insulated above-freezing food storage compartment and a freezer food storage compartment therein, an evaporator compartment separated from said compartments, a source of electrical power, an evaporator in said evaporator compartment, a fan for circulating air via inlet conduit means from the food storage compartments in thermal exchange relationship past said evaporator, exit conduit means for returning the cooled air from said evaporator compartment to said food storage compartments, a compressor for supplying liquid refrigerant to said evaporator, an electrical defrost heater for periodically warming said evaporator to defrost temperatures, a defrost thermostat switch in said evaporator compartment for limiting the duration of the defrost periods, a temperature responsive cold control switch for energizing said compressor, a defrost timer switch for periodically energizing said heater defrosting said evaporator, said defrost timer means including a switch for selectively energizing either said compressor or said electric defrost heater means, the improvement wherein means for supporting said defrost thermostat for sensing the flow of air leaving said evaporator compartment, a control circuit electrically connecting one side of said defrost thermostat to one side of said power source and the other side of said defrost thermostat with one side of said defrost heater, said defrost heater means having its other side connected to a first fixed contact of said defrost timer switch, said circuit means connecting one side of said fan with said other side of said defrost thermostat, said circuit means connecting the other side of said fan with a movable contact of said defrost timer switch, said defrost timer movable contact connected by said circuit control means through said cold control switch to the other side of said power source, a second fixed contact of said defrost timer connected by said circuit control through said compressor motor to said one side of said power source, whereby said fan is energized in unison with said defrost heater upon said defrost timer movable contact being moved into contact with said first fixed contact to start a defrost cycle, and whereby upon said defrost thermostat sensing an above-freezing temperature of air leaving said evaporator compartment after frost on said evaporator has melted said defrost thermostat deenergizes said defrost heater and said fan, said control circuit causing said fan to remain deenergized until said defrost thermostat senses a below-freezing temperature of air leaving said evaporator compartment after moisture remaining on said evaporator has been refrozen after defrost, thereby resulting in a minimum of moisture laden cooled air being circulated through said exit conduit means to obviate accumulated frost buildup therein and whereby the run time for said fan is minimized.

2. In combination, a refrigerator cabinet having an insulated above-freezing food storage compartment and a freezer food storage compartment therein, an evaporator compartment separated from said compartments, a source of electrical power, an evaporator having forward and rearward edges in said evaporator compartment, fan means for circulating air via inlet conduit means from the food storage compartments in thermal exchange relationship past said evaporator in a longitudinal flow path from the forward to the rearward edges thereof, exit conduit means for returning the cooled air to said food storage compartments, a compressor for supplying liquid refrigerant to said evaporator, electrical defrost heater means for periodically warming said evaporator to defrost temperatures, defrost thermostat switch means for limiting the duration of the defrost periods, temperature responsive cold control switch means for energizing said compressor, a defrost timer switch for periodically energizing said heater means defrosting said evaporator, said defrost timer means including a switch for selectively energizing either said compressor or said electric defrost heater means, the improvement wherein bracket means supporting said defrost heater means at the forward edge of said evaporator, bracket means supporting said defrost thermostat in heat exchange contact with the rearward edge of said evaporator for sensing the flow of air leaving said evaporator, control circuit means electrically connecting one side of said defrost thermostat to one side of said power source and the other side of said defrost thermostat with one side of said defrost heater means, said defrost heater means having its other side connected to a first fixed contact of said defrost timer switch, said circuit means connecting one side of said fan means with said other side of said defrost thermostat, said circuit means connecting the other side of said fan means with a movable contact of said defrost timer switch, said defrost timer movable contact connected by said circuit control means through said cold control switch means to the other side of said power source, a second fixed contact of said defrost timer connected by said circuit control means through said compressor motor to said one side of said power source, whereby said fan means is energized in unison with said defrost heater means upon said defrost timer movable contact being moved into contact with said first fixed contact to start a defrost cycle, and whereby upon said defrost thermostat sensing a predetermined above-freezing temperature of air leaving the rearward edge of said evaporator after frost on said evaporator has melted said defrost thermostat deenergizes said defrost heater means and said fan means, said control circuit means causing said fan means to remain deenergized until said defrost thermostat senses a predetermined below-freezing temperature of air leaving the rearward edges of said evaporator fins after moisture remaining on said evaporator has been refrozen after defrost, thereby resulting in a minimum of moisture laden cooled air being circulated through said exit conduit means to obviate accumulated frost buildup therein and whereby the run time for said fan means is minimized.

3. In combination, a refrigerator cabinet having an insulated above-freezing food storage compartment and a freezer food storage compartment therein, an evaporator compartment separated from said compartments, a source of electrical power, an evaporator in said evaporator compartment having refrigerant carrying coils equipped with a plurality of longitudinally extending fins, fan means for circulating air via inlet conduit means from the food storge compartments in thermal exchange relationship past said evaporator in a longitudinal flow path from the forward to the rearward edges of said fins, exit conduit means for returning the cooled air to said food storage compartments, a compressor for supplying liquid refrigerant to said evaporator, electrical defrost heater means for periodically warming said evaporator to defrost temperatures, defrost thermostat switch means for limiting the duration of the defrost periods, temperature responsive cold control switch means for energizing said compressor, a defrost timer switch for periodically energizing said heater means defrosting said evaporator, said defrost timer means including a switch for selectively energizing either said compressor or said electric defrost heater means, the improvement wherein first support bracket means attached to said evaporator supports said defrost heater means at the forward edge of said fins, second support bracket means attached to said evaporator supports said defrost thermostat in heat exchange contact with the rearward edge of one or more of said fins for sensing the flow of air leaving said evaporator, control circuit means electrically connecting one side of said defrost thermostat to one side of said power source and the other side of said defrost thermostat with one side of said defrost heater means, said defrost heater means having its other side connected to a first fixed contact of said defrost timer switch, said circuit means connecting one side of said fan means with said other side of said defrost thermostat, said circuit means connecting the other side of said fan means with a movable contact of said defrost timer switch, said defrost timer movable contact connected by said circuit control means through said cold control switch means to the other side of said power source, a second fixed contact of said defrost timer connected by said circuit control means through said compressor motor to said one side of said power source, whereby said fan means is energized in unison with said defrost heater means upon said defrost timer movable contact being moved into contact with said first fixed contact to start a defrost cycle, and whereby upon said defrost thermostat sensing an above-freezing temperature of air leaving the rearward edges of said evaporator fins after frost on said evaporator has melted said defrost thermostat deenergizes said defrost heater means and said fan means, said control circuit means causing said fan means to remain deenergized until said defrost thermostat senses a below-freezing temperature of air leaving the rearward edges of said evaporator fins after moisture remaining on said evaporator has been refrozen after defrost, thereby resulting in a minimum of moisture laden cooled air being circulated through said exit conduit means to obviate accumulated frost buildup therein and whereby the run time for said fan means is minimized.

* * * * *